US010070744B2

(12) United States Patent
Schiff

(10) Patent No.: US 10,070,744 B2
(45) Date of Patent: Sep. 11, 2018

(54) TRAY

(71) Applicant: Anthony Schiff, New York, NY (US)

(72) Inventor: Anthony Schiff, New York, NY (US)

( * ) Notice: Subject to any disclaimer, the term of this patent is extended or adjusted under 35 U.S.C. 154(b) by 372 days.

(21) Appl. No.: 15/053,341

(22) Filed: Feb. 25, 2016

(65) Prior Publication Data

US 2016/0360913 A1 Dec. 15, 2016

Related U.S. Application Data

(60) Provisional application No. 62/174,601, filed on Jun. 12, 2015.

(51) Int. Cl.

| | |
|---|---|
| ***B65D 1/34*** | (2006.01) |
| ***A47G 23/06*** | (2006.01) |
| ***A47G 23/02*** | (2006.01) |
| *B65D 1/36* | (2006.01) |

(52) U.S. Cl.

CPC ..... *A47G 23/0625* (2013.01); *A47G 23/0216* (2013.01); *B65D 1/36* (2013.01)

(58) Field of Classification Search

CPC ..... A47G 19/065; A47G 23/0216; A47G 23/0625; B65D 1/36

USPC ..... 206/557, 561; 220/555, 556, 575

See application file for complete search history.

(56) References Cited

U.S. PATENT DOCUMENTS

| | | | | |
|---|---|---|---|---|
| 1,071,705 | A * | 9/1913 | Collins | A47G 23/06 294/144 |
| 5,346,070 | A * | 9/1994 | McSpadden | A47G 19/065 206/561 |
| 5,593,062 | A * | 1/1997 | Martin | A47G 19/065 220/556 |
| 5,803,305 | A * | 9/1998 | Perlis | A47G 19/065 206/558 |
| 6,264,026 | B1 * | 7/2001 | Bradley | A47G 19/065 206/217 |
| 6,622,885 | B1 * | 9/2003 | Erman | A47G 23/0625 220/571 |
| 2010/0108560 | A1 * | 5/2010 | Macarthur-Onslow | A47G 19/065 206/561 |
| 2014/0367392 | A1 * | 12/2014 | McClinton | A47G 19/065 220/574 |

* cited by examiner

*Primary Examiner* — Luan K Bui
(74) *Attorney, Agent, or Firm* — Pearl Cohen Zedek Latzer Baratz LLP

(57) ABSTRACT

A tray, platter or carrying structure may include a substantially flat lower surface or panel, a substantially flat upper surface or panel, a first set of side walls extending between the lower surface or panel and the upper surface, and a second set of side walls extending upward from the lower surface. The first and second set of side walls may form, with the lower surface, a compartment for carrying for example drinks, food or other items. The first set of side walls may form with the upper surface an inset for a user to insert a hand to hold the tray. A grip may extend down from or be connected to the upper surface into the inset. A bar may extend from one side wall to another side wall to form an opening surrounded by the bar, two side walls, and the upper surface.

14 Claims, 4 Drawing Sheets

TRAY

PRIOR APPLICATION DATA

The present application claims benefit from prior provisional application 62/174,601 entitled "Tray", filed on Jun. 12, 2015, incorporated by reference herein in its entirety.

FIELD OF THE INVENTION

The present invention generally relates to a tray, for example for carrying food and drinks in a restaurant or bar.

BACKGROUND

Conventional trays or platters used to bring drinks from a bar (e.g., in a restaurant, a tavern) to a table force the user, e.g., the waiter or waitress, to balance a set of unstable glasses or bottles on top of a flat, open tray, often in a crowded restaurant or bar where the tray or the user's arm may be jostled while moving through the restaurant or bar. Objects such as bottles or glasses with significant enough height are subject to toppling over if transported on a conventional flat surfaced tray.

There is a need for a tray or device allowing a server to carry drinks or other items, while providing more stability for the items, in a crowded environment.

SUMMARY

A tray, platter or carrying structure may include a substantially flat lower surface or panel, a substantially flat upper surface or panel, a first set of side walls extending between the lower surface or panel and the upper surface, and a second set of side walls extending upward from the lower surface. The first and second set of side walls may form, with the lower surface, a compartment for carrying for example drinks, food or other items. The first set of side walls may form with the upper surface an inset for a user to insert a hand to hold the tray. A grip or handle may extend down from or be connected to the upper surface into the inset. A bar or beam, or a flat panel or other shape, may extend from one side wall to another side wall to form an opening surrounded by the bar, two side walls, and the upper surface.

BRIEF DESCRIPTION OF THE DRAWINGS

Various exemplary embodiments are illustrated in the accompanying figures with the intent that these examples not be restrictive. It will be appreciated that for simplicity and clarity of the illustration, elements shown in the figures referenced below are not necessarily drawn to scale. Also, where considered appropriate, reference numerals may be repeated among the figures to indicate like, corresponding or analogous elements. Of the accompanying figures.

Figure 1A:
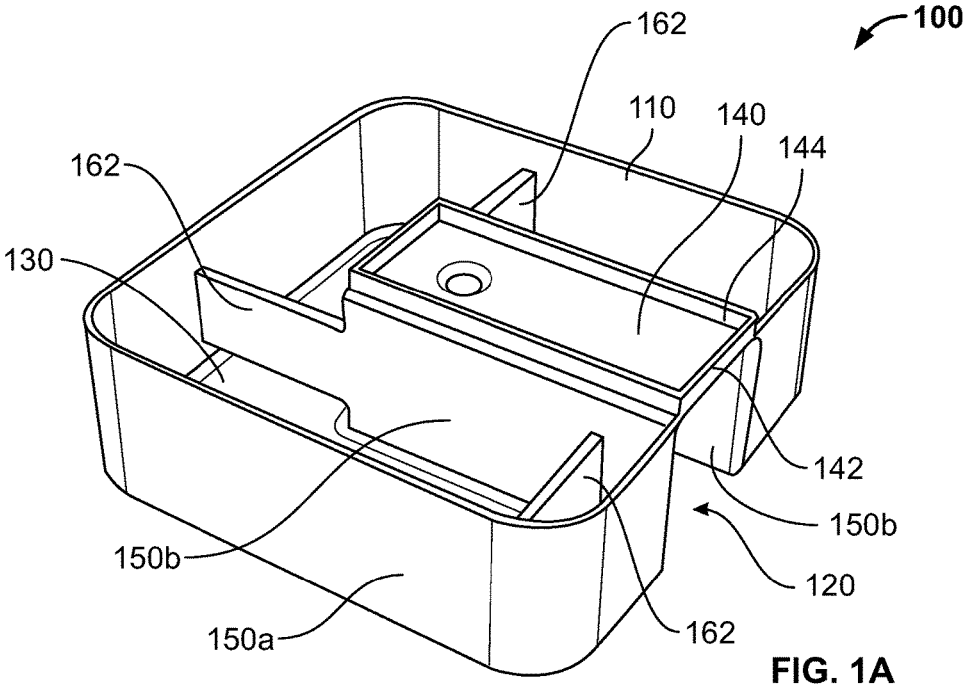
FIGS. 1A, 1B, 1C and 1D depict a carrying device or tray according to an embodiment of the present invention.
Figure 1B:
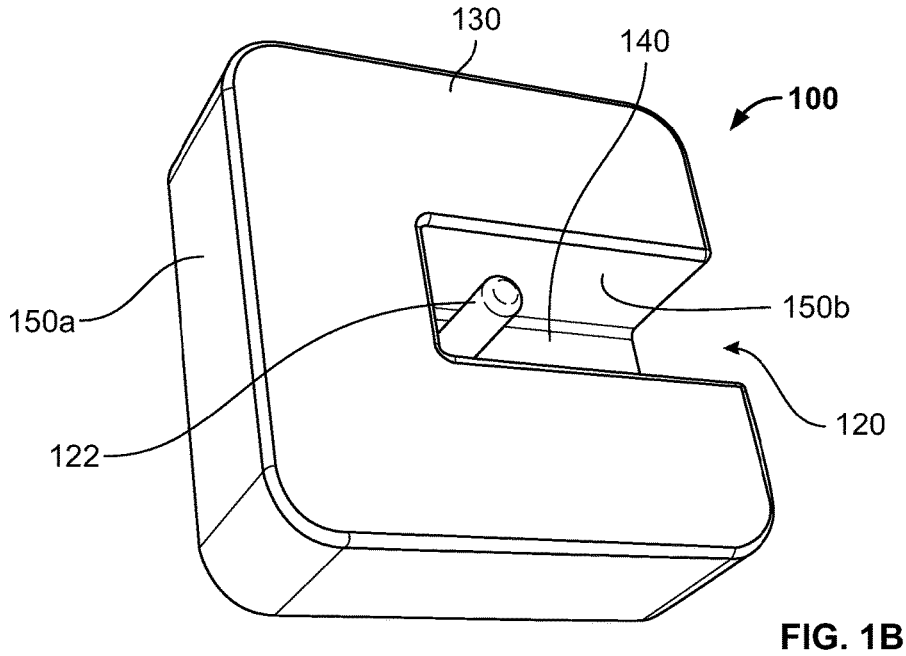
Figure 1C:
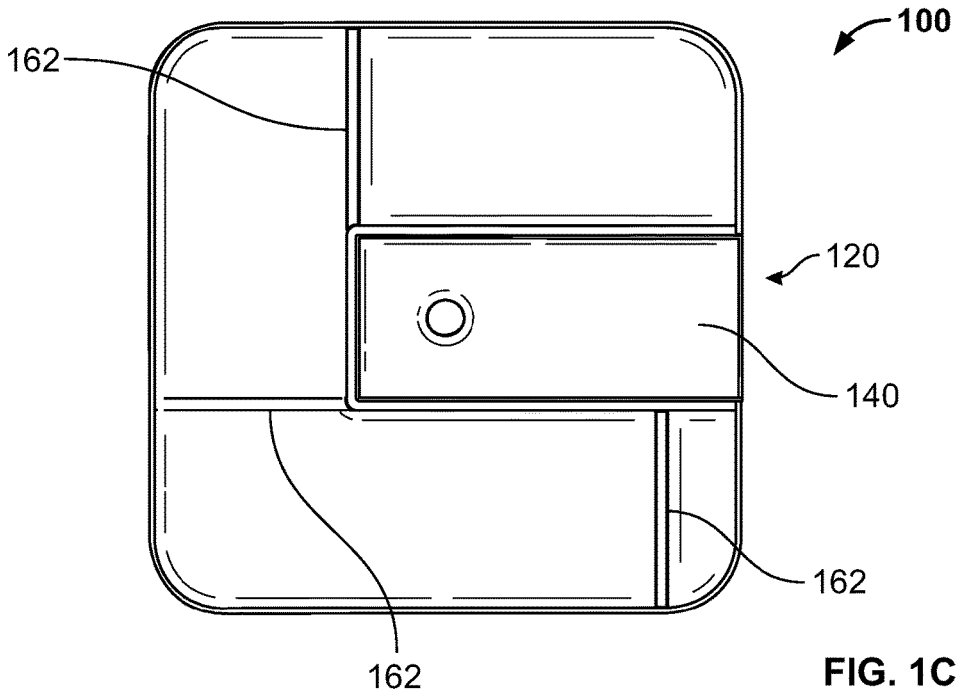
Figure 1D:
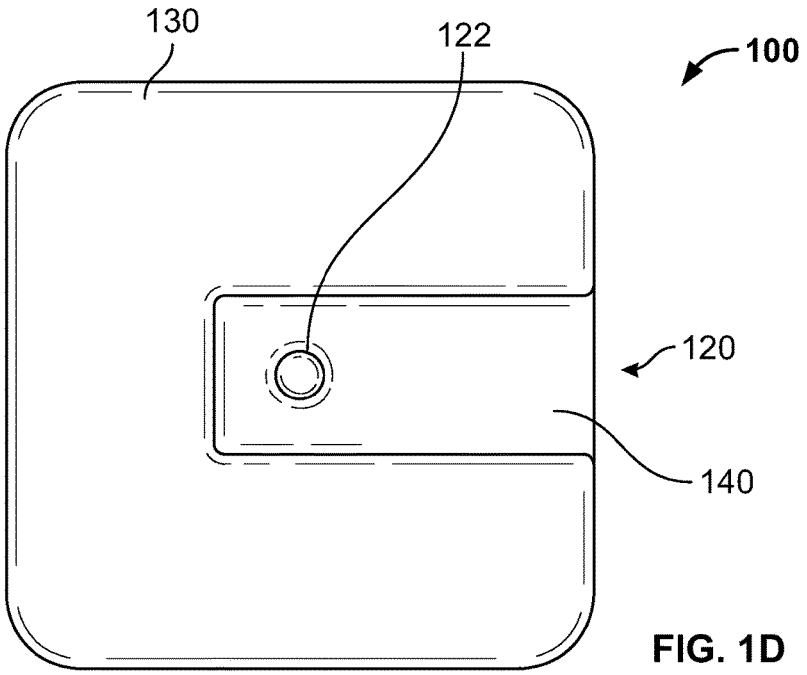

The principles and operation of the system and method according to the present invention may be better understood with reference to the drawings, and the following description, it being understood that these drawings are given for illustrative purposes only and are not meant to be limiting.

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details presented herein. Furthermore, well known features may be omitted or simplified in order not to obscure the present invention. The following description is not intended to limit the scope of the claims but instead to explain various principles of the invention and the manner of practicing it.

An embodiment of the invention is a carrying device, carrying structure, platter or tray for the safe transport of objects (e.g., objects having significant enough height, that makes them subject to toppling over if transported on a conventional flat surfaced tray). The tray may include a U-shaped carrying portion or well for carrying objects which surrounds a holding portion, compartment or inset into which a user can insert a hand or portion of an arm to grasp a grip or handle located for example in the center of the tray. The user may grip the handle to stabilize and carry the tray, and in one embodiment some or all of the weight of the tray may be supported on the user's hand or arm by an upper surface or panel of the holding portion resting on the hand or arm. An embodiment of the tray may include two parallel or substantially parallel (to each other) flat surfaces: a lower or bottom surface on which bottles, glasses, drinks, etc., may be supported, and an upper or top surface forming the top wall of an inset (the upper surface being the upper surface of the holding portion). In some embodiments a top wall of an inset, or a top surface, need not be used. An embodiment of the tray may include side walls extending (e.g. upward) from the lower, flat or substantially flat, or generally flat surface, and also side walls extending (e.g. downward) from the upper surface. The side walls (possibly in combination with additional walls or separators) may include or form receptacles or compartments which may stabilize drinks, beer bottles, glasses, tall glasses, wine glasses, or other objects. The upper or top surface may have a shape of a cutout, such that the bottom or lower surface has a shape of the cutout, or a shape significantly close to that of the cutout.

Each of the upper and/or lower surfaces or panels may be flat or substantially flat but may have other shapes or configurations.

A center vertical handle, grip or extension (e.g., in the form of a cylinder, a cone, tapered, frustoconical, or another shape), may be attached or connected to and extend down from a bottom side of the upper surface or panel of the tray. The handle may be surrounded by the inset or holding portion (the upper surface of the inset may have the shape of the cutout of the upper surface of the tray), which opens opposite to the drink compartment(s). A user or carrier may insert his or her hand into the inset to hold the handle and support the tray. The inset may be open to the bottom side of the tray and may extend to the top surface of the tray, so that the side walls extending down from the top surface of the tray, and also forming the inset, form the inner part of a U-shaped receptacle.

The U-shaped, or other shaped, well or receptacle may be a compartment or series of compartments on and open to the top of the tray, having as a bottom the bottom surface of the tray, and having significant enough depth to prevent objects (such as drink ware) from toppling over if the tray is not held at an angle other than solely, or very close to, parallel to the ground.

The upper and lower surfaces need not be flat or substantially flat, and can include more complex shapes than a surface or plane. In some embodiments the tray is substantially square with rounded edges when seen from above, but may be a different shape.

On the bottom of the tray may be an inset (formed by the top surface and side walls) which, when viewed from the top of the tray, forms an upward facing projection, such that the tray, if in a generally square configuration, has a drink carrying portion or compartment (formed by the side walls and bottom surface) in the shape of a squared-off U. An additional compartment, defined by walls extending upward from the upper surface, may exist on the top or upper side of the inset, on the top of the upward facing projection, and on the top or upper surface.

The holder or carrier of the tray (e.g., a waiter or waitress) may be able to hold the tray via (e.g., by gripping) the handle extending down from the bottom of the top surface of the inset, with one hand, and still have control over the tray and the ability to adjust the angle at which the tray is held with respect to the ground.

FIGS. 1A, 1B, 1C, and 1D show various views of a tray or article carrier according to an embodiment of the present invention. Article carrier 100 includes U-shaped well or carrying portion 110 surrounding or defining a holding portion, compartment or inset 120 into which a user can insert an arm to grasp extension, grip or handle 122. While in one embodiment grip or handle 122 is supported by and extends from upper surface or panel 140, typically into inset 120, grip or handle 122 may be otherwise supported, and may extend from another structure. Inset 122 may be open both to one side of tray 100 (e.g., perpendicular to the direction carrying portion 110 is open), and open in a direction opposite to the direction to which carrying portion 110 is open. Grip or handle 122 may be for example a frustoconical shape. Grip or handle 122 may have other shapes, such as a cylinder, or a square cross-section. Lower or bottom wall, panel or surface 130 may support objects, and upper or top wall, panel or surface 140 may be a top wall of inset 120. (All or portion of surfaces 130 and/or 140 may be omitted in some embodiments.) Side panels or walls 150*a* may extend up from lower surface 130 and side panels or walls 150*b* may extend down from upper surface 140 and meet or connect with lower surface 130. Side panels or walls 150*a* and 150*b* may connect with each other and may form one continuous set of walls. In other embodiments side panels and walls need not be continuous and may have holes, cutouts, etc. Side panels or walls 150*a* and 150*b* may connect upper surface 140 and lower surface 130, and upper surface 140 and lower surface 130 may be parallel to each other, but need not be.

U-shaped carrying portion, well, receptacle or compartment 110 (e.g. formed by walls 150*a* and 150*b* and lower surface 130) may hold objects such as drinks or glasses, and may be divided by additional or internal walls, dividers or separators 162. Other internal separator arrangements may be used. In one embodiment, internal walls 162 do not extend to the full height of walls 150*a* and/or 150*b*. For example, in the example shown there is a gap between the lower part internal walls 162 and lower surface 130 and a gap between the upper part of internal walls 162 and the upper part of walls 150*a*. However, internal walls 162 may extend to the full height of walls 150*a* and/or 150*b*. Internal walls 162 may include cut-outs, or may be solid.

While handle 122 is typically located in the center of tray 100 it may be otherwise located, and while it is typically perpendicular to upper surface 140 it need not extend perpendicularly down into inset 120, and may have a different shape. In other embodiments handle 122 may be omitted. For example, tray 100 may be held like a traditional prior art flat tray where a user supports the tray using a flat open hand. Alternately a different handle may be used, such as a horizontal handle held for example by a user's palm facing upward, or no handle may be used.

A top wall or set of panels 142 may extend up from upper surface 140 to define an area 144 to hold e.g., money, order slips or checks, pens, smaller objects or drinks, etc. Area 144 may be defined by walls or panels 142 rising above inset area 120, and area 144 may be open in the same direction as the direction to which the compartment or well 110 opens. Upper surface 140, from which may extend handle 122, may in other embodiments have a configuration different from a flat panel.

When used herein upper, lower, top, bottom, etc. are relative terms matched to the orientation of the tray 100 when in typical use, such that receptacle or compartment 110 opens upward, and compartment or inset 120 faces downward.

In one embodiment walls 150*a* and/or 150*b* are at right angles or substantially right angles to surfaces 130 and/or 140 at their respective intersections. Other angles may be used.

While in one embodiment shown tray 100 when viewed from above or below is square with rounded corners, other shapes, such as circular, oval, rectangular, non-rounded edges, etc., may be used. If other shapes are used upper compartment 110 may not be U-shaped. In one embodiment tray 100 is for example 12 or 12.57 inches square when seen from its top. (In an embodiment described elsewhere, the top may be is wider than the bottom (e.g., the bottom may be 11.91 inches square) due to tapering and a non-right angle between the side walls and top and bottom surfaces.) In one embodiment tray 100 is 4 inches tall. In one embodiment compartment or inset 120 is approximately 3.5 inches wide and for example 8, 7.8 or 7.58 inches long. Compartment, well or carrying area 110 supported by lower surface 130 may be for example between 3.5 and 4 inches wide. Grip or handle 122 may be for example a cylinder having a one inch diameter and may extend from the top surface to approximately a plane defined by the bottom surface. In another embodiment the grip may be for example a frustoconical shape being approximately 1-2 inches in diameter (e.g., 1.47 inches) at its top when connecting with surface 140, and have a smaller diameter, e.g., 0.8 inches, at its lower, terminal end. A top wall or set of panels may extend for example 0.5 inches up from the upper surface 140 to define a smaller upper storage area. Other dimensions may be used.

Figure 2A:
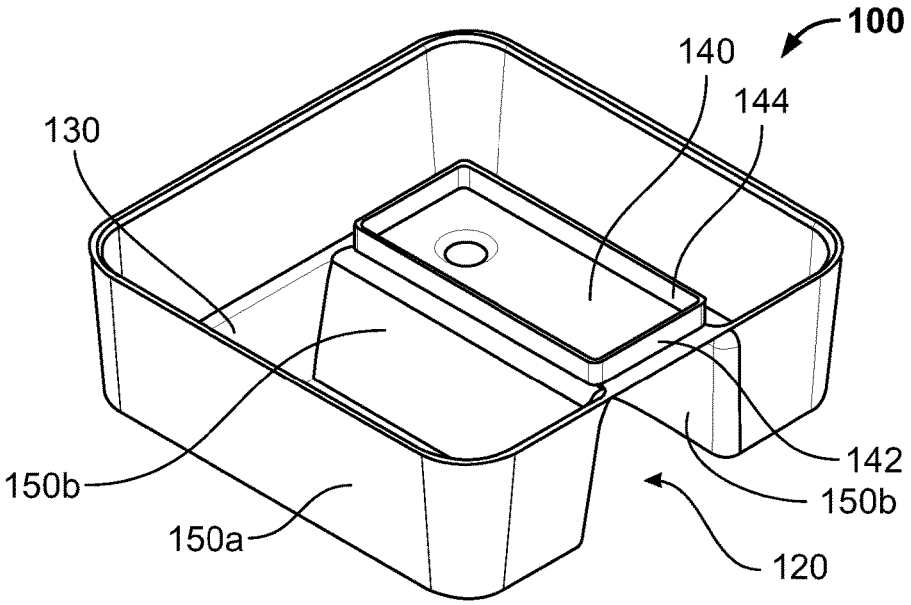
FIGS. 2A and 2B depict a carrying device or tray according to an embodiment of the present invention with tapered sides, and in FIG. 2B, stacked.
Figure 2B:
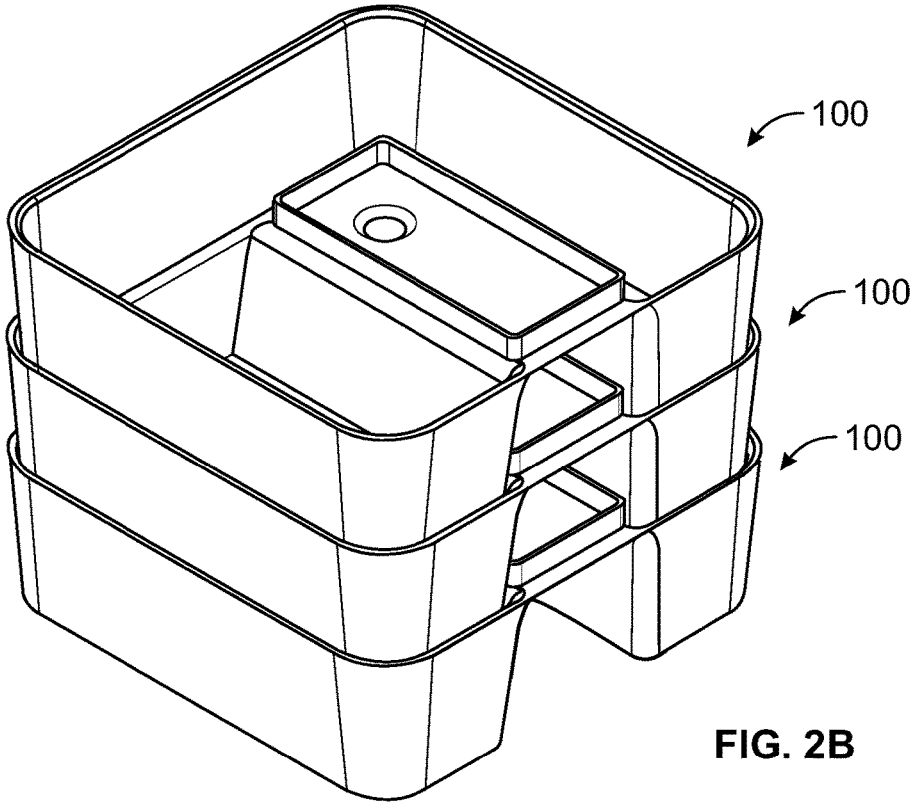

FIGS. 2A and 2B depict a carrying device or tray according to an embodiment of the present invention within tapered sides, and in FIG. 2B, stacked. Side walls 150*a* and/or 150*b* may be angled (other than at a right angle) or tapered with respect to bottom surface 130 and/or top surface 140, for example in order to allow the trays to be nested or stackable in each other. For example, side walls 150*a* and/or 150*b* may have a 95 degree angle, or another angle, with respect to bottom surface 130. In an embodiment where the trays are stackable, internal walls or separators 162 may not be included, and a cross-beam may not be included.

A bar or other structure may extend across the inset where a user inserts her hand or arm, from one part of the bottom surface to another. This may add stability to the structure and/or provide additional support, e.g., on the wrist of the holder. In one embodiment a bar or cross-beam may extend from one side wall to another side (e.g., connect the side walls) wall to form an opening surrounded by the bar or beam, two side walls, and the upper surface.

Figure 3:
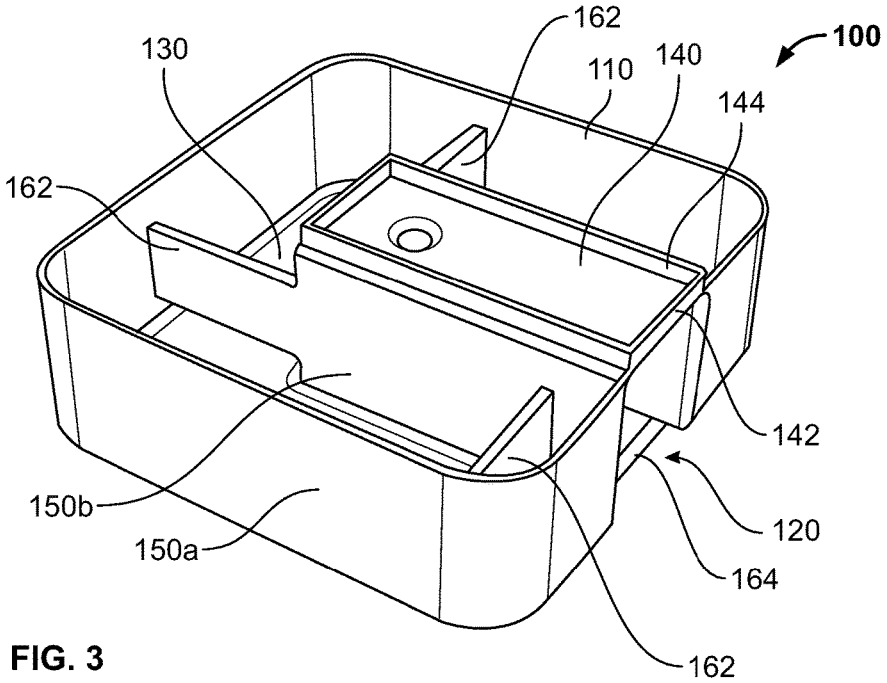
FIG. 3 depicts a carrying device or tray with a cross-beam.

FIG. 3 depicts a carrying device or tray with a cross-beam. In tray 100, a support structure, bar or beam 164 may extend from one side wall 150*b* to another side wall 150*b*, or from one portion of bottom surface 130 to another portion of bottom surface 130. Support structure, bar or beam 164 may be used to maintain strength and structural integrity of tray 100, and/or to help a person carry tray 100. Support structure 164 may extend across compartment or inset 120. In such a manner bar 164, two side walls 150*b*, and top surface 140 may form an opening into which a user may insert a hand or arm. Holding portion or inset 120 may be formed for example by walls 150*b*, top surface 140, and bar 164. Support structure 164 may have various shapes, e.g., a flat panel, a round or square cross-section tube or bar, etc.

Figure 4:
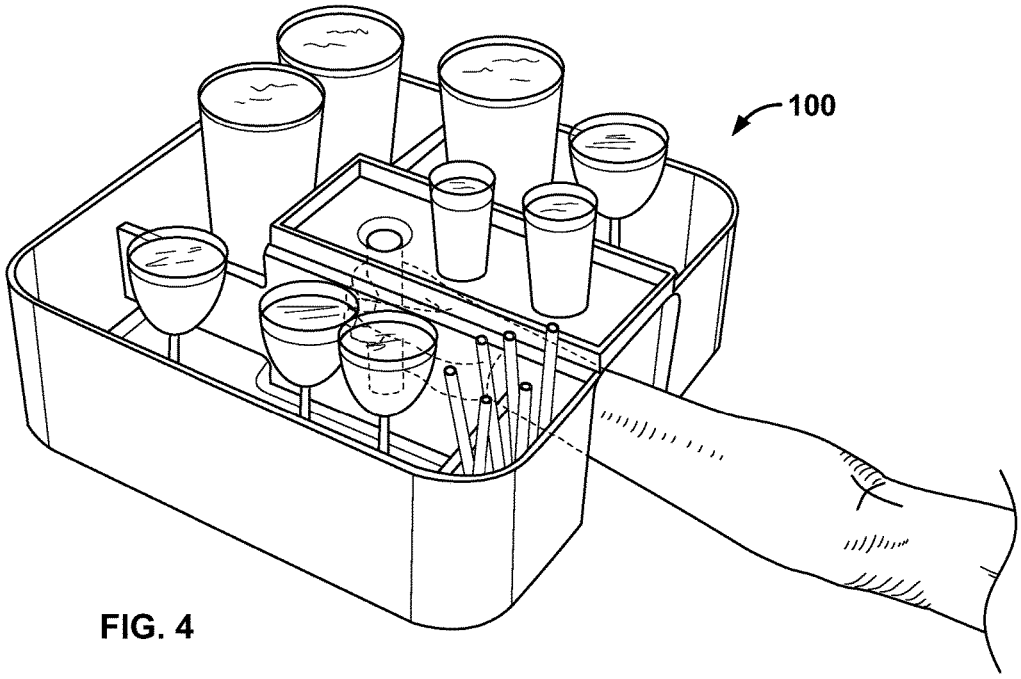
FIG. 4 depicts a carrying device or trays holding drinks and glasses.

FIG. 4 depicts a carrying device holding drinks, glasses and straws. In FIG. 4, a person's arm can be seen (in dotted line when inserted into an inset) holding the tray by holding a handle (also in dotted line).

The receptacles on the upper compartment(s) of the tray may have both open space and partitions which may add to the strength and resiliency of the tray while also providing the objects in the tray a third (or more) potential wall to prevent toppling. While in one figure partitions are shown in the drink-holding compartment, partitions may not be used, and other configurations of partitions may be used.

The handle in one embodiment may be a cylinder extending from the lower part of an upper surface, but other shapes, configurations, and arrangements may be used. In one embodiment the handle may be hollow and may have an opening extending from the top surface; e.g., the top surface may have an opening or hole which extends down into the handle. The handle may be centrally located as to provide balance when the tray is partially or fully loaded as well as to allow for example half (or other portions) the length of the tray to rest on the carrier's wrist and forearm.

The tray may be made of strong enough material such that when the receptacles are fully loaded it maintains its shape and integrity. In one embodiment the material is of light enough weight that when the receptacle is full, the tray can still be carried by a person of normal or reasonable strength. For example, the tray may be made of plastic, polyethylene, ABS (crylonitrile butadiene styrene) or other thermoplastic polymer, although other materials may be used, for example paper or cardboard. The tray may be formed of one piece of material and may be injection molded, but need not be.

In one embodiment the tray may include a substantially flat lower surface, and a substantially flat upper surface, where the two surfaces are in one embodiment substantially parallel. A first set of side walls may extend between the lower surface and the upper surface, and a second set of side walls may extend upward from the lower surface (a "set" of side walls may be one continuous wall). The first and second set of side walls may form with the lower surface, a compartment or well for carrying drinks, etc., and the first set of side walls may form with the upper surface, an inset for a user to insert a hand to hold the tray. A handle may extend down from the upper surface into the inset.

While embodiments are described for carrying drinks in a restaurant or bar, embodiments may carry other items (e.g., food, construction material, manufacturing parts, objects for sale), and embodiments may be used in contexts other than a restaurant, for example in the home, at a stadium, in a factory, etc. For example a carrying article as disclosed herein my be used by a worker carrying items up a ladder, in a hospital, or by a person at home carrying items and keeping one hand free for opening doors.

The articles "a"/"an" are used herein to refer to at least one) of the grammatical object of the article, depending on the context. For example, "an element" can mean one element or more than one element. The term "including" is used herein to mean, and is used interchangeably with, the phrase "including but not limited to". Having described exemplary embodiments of the invention, it will be apparent to those skilled in the art that modifications of the disclosed embodiments will be within the scope of the invention. Alternative embodiments may, accordingly, include more elements or functionally equivalent elements. Various embodiments may include elements from other embodiments. The scope of the claims that follow is not limited by the disclosure herein.

The invention claimed is:

1. A tray comprising:

a flat lower surface;

an flat upper surface;

a first set of side walls extending between the lower surface and the upper surface;

a second set of side walls extending upward from the lower surface, wherein the angle between the lower surface and the second set of side walls is a substantially right angle and the angle between each of the lower surface and the upper surface, and the first set of side walls is a substantially right angle;

at least one inner separator wall extending from and parallel to at least one of the first set of side walls;

the first and second set of side walls, forming with the lower surface, a compartment for carrying objects;

the first set of side walls forming with the upper surface, an inset for a user to insert a hand to hold the tray; and a cylindrical handle extending from the upper surface into the inset, the handle being perpendicular to the upper surface and located at the center of the tray;

wherein the tray is substantially square when seen from above.

2. The tray of claim 1 comprising a bar extending from one side wall to another side wall to form an opening surrounded by the bar, two side walls, and the upper surface.

3. The tray of claim 1, wherein the lower surface is substantially flat.

4. The tray of claim 1, wherein the upper surface is substantially flat.

5. The tray of claim 1, wherein the tray is one unitary piece of material.

6. A carrying device comprising:

a first flat panel for supporting objects, the first panel connected to a second flat panel by a set of walls, the first and second panels parallel to each other;

at least one inner separator wall extending from and parallel to at least one of the set of walls;

the walls and first panel forming a compartment for carrying the objects;

the walls and the first panel forming a substantially right angle, and the walls and the second panel forming a substantially right angle;

the walls forming with the second panel, a compartment for a user to insert a hand to hold the device, the compartment for carrying the objects defining and surrounding the compartment for a user to insert a hand, and the compartment for a user to insert a hand open to one side of the tray in a direction perpendicular to the direction to which the compartment carrying objects is open; and a handle connected to the second panel and perpendicular to the second panel and located at the center of the tray;

wherein the carrying device is substantially square when seen from above.

7. The carrying device of claim 6 comprising a beam extending across the compartment for a user to insert a hand.

8. The carrying device of claim 6, wherein the first panel is generally flat.

9. The tray carrying device of claim 6, wherein the second panel is generally flat.

10. The carrying device of claim 6, wherein the carrying device is one unitary piece of material.

11. A tray comprising:

a well for carrying objects, the well defined by a flat bottom portion and side walls;

a top portion parallel to the bottom portion and connecting with the side walls at a substantially right angle; and the well defining and surrounding an inset, the inset comprising a cylindrical handle extending from the top portion into the inset, the handle perpendicular to the top portion, the inset both open to one side of the tray, and open in a direction opposite to the direction to which the well is open;

wherein the tray is substantially square when seen from above.

12. The tray of claim 11 comprising a bar extending from one side wall to another side wall across the inset.

13. The tray of claim 11, wherein the bottom portion surface is substantially flat.

14. The tray of claim 11 comprising a set of walls rising above the inset, open to the same direction as the direction the well opens to.

* * * * *